US007421940B2

(12) United States Patent
Nissen et al.

(10) Patent No.: US 7,421,940 B2
(45) Date of Patent: Sep. 9, 2008

(54) PISTON COMPRESSOR, PARTICULARLY HERMETICALLY ENCLOSED REFRIGERANT COMPRESSOR

(75) Inventors: Jens Erik Nissen, Graasten (DK); Frank Holm Iversen, Padborg (DK)

(73) Assignee: Danfoss Compressors GmbH, Flensburg (DE)

( * ) Notice: Subject to any disclaimer, the term of this patent is extended or adjusted under 35 U.S.C. 154(b) by 799 days.

(21) Appl. No.: 10/448,602

(22) Filed: May 29, 2003

(65) Prior Publication Data

US 2003/0223891 A1 Dec. 4, 2003

(30) Foreign Application Priority Data

Jun. 1, 2002 (DE) ..... 102 24 428

(51) Int. Cl.
*F01B 31/10* (2006.01)

(52) U.S. Cl. ..... 92/159; 92/160

(58) Field of Classification Search ..... 92/159, 92/160

See application file for complete search history.

(56) References Cited

U.S. PATENT DOCUMENTS

| | | | | |
|---|---|---|---|---|
| 4,189,984 | A | 2/1980 | Tankred et al. | 92/82 |
| 4,478,559 | A | 10/1984 | Andrione et al. | |
| 4,794,848 | A * | 1/1989 | Melchior | 92/159 |
| 5,118,263 | A | 6/1992 | Fritchman | |
| 5,118,563 | A | 6/1992 | Akao | |
| 6,457,561 | B1 * | 10/2002 | Goodnight | 92/160 |
| 6,702,067 | B2 | 3/2004 | Iversen et al. | |
| 2002/0050425 | A1 | 5/2002 | Iversen et al. | |

* cited by examiner

*Primary Examiner*—F. Daniel Lopez
(74) *Attorney, Agent, or Firm*—McCormick, Paulding & Huber LLP

(57) ABSTRACT

The invention concerns a piston compressor, particularly a hermetically enclosed refrigerant compressor, with at least one cylinder a piston reciprocating in said cylinder, the piston being connected with a driving rod via a piston pin and having in its outer jacket surface a circumferential lubrication groove, the piston pin having a longitudinal bore, which is connected with a lubricant source. It is endeavoured to improve the lubrication. For this purpose, the longitudinal bore is open downward in the gravity direction and has a ventilation opening upward.

10 Claims, 1 Drawing Sheet

PISTON COMPRESSOR, PARTICULARLY HERMETICALLY ENCLOSED REFRIGERANT COMPRESSOR

CROSS-REFERENCE TO RELATED APPLICATIONS

This application is entitled to the benefit of and incorporates by reference essential subject matter disclosed in German Patent Application No. 102 24 428.6 filed on Jun. 1, 2002.

FIELD OF THE INVENTION

The invention concerns a piston compressor, particularly a hermetically enclosed refrigerant compressor, with at least one cylinder and a piston reciprocating in said cylinder, the piston being connected with a driving rod via a piston pin and having in its outer jacket surface a circumferential lubrication groove, the piston pin having a longitudinal bore, which is connected with a lubricant source.

BACKGROUND OF THE INVENTION

A piston compressor of this kind is known, for example, from U.S. Pat. No. 4,478,559. The driving rod is formed by a connecting rod, which is provided with a longitudinal bore, through which the lubricating oil is conveyed from a crankshaft-side end of the connecting rod to the piston pin. In the piston pin is provided a radial bore, through which the lubricating oil reaches the longitudinal bore. In the longitudinal bore the lubricating oil is pressed upward and thus reaches the lubrication groove, which extends on the outside of the piston. Here the oil supports the lubrication of the working surfaces of cylinder and piston and the sealing between cylinder and piston.

U.S. Pat. No. 5,118,263 shows a further hermetically enclosed refrigerant compressor, which has on the outside of the cylindrical surface of the piston pin a circumferential lubrication groove, which is connected with the opening of a longitudinal bore in the connecting rod and serves the purpose of supplying lubricating oil to the pin bearing formed in the piston-side connecting rod eye. Subsequently, the oil leaving the pin bearing reaches the lubrication groove on the outside of the piston, there supporting the lubrication of the working surfaces of cylinder and piston and contributing to an improved sealing between cylinder and piston. However, the amount of oil reaching the cylinder in this way is relatively small. For this reason, additional oil is supplied directly, however without pressure, through an opening formed on the upper side of the cylinder block, said opening ending in the area of the circumferential piston groove. A lubrication groove in the piston pin for distributing the oil weakens the creation of a stable oil film in the pin bearing.

In many cases, the lubrication groove formed in the outer cylindrical surface of the piston jacket is not always completely filled with oil, but a certain amount of gas remains, particularly in the upper area of the lubrication groove. Here, compressed refrigerant gas from the compression chamber of the cylinder can penetrate into the lubrication groove through the gap between piston and cylinder. Through a ventilation opening formed in the piston, the resulting gas-oil mixture is pressed into the inside volume of the compressor housing, which causes an undesirable noise generation. Further, the efficiency of the compressor is decreased, as compressed refrigerant gas is lost.

Further noises occur in that the high pressure of the compressed refrigerant gas causes a share of the gas-oil mixture to be pressed back into the drive system through the oil supply system, that is, the longitudinal bore in the connecting rod, from where it can be pressed out through openings in the crankshaft. Additionally, this may have a negative effect on the sufficient lubrication of the bearing, that is, the crankshaft side pin bearing.

The invention is based on the task of improving the lubrication.

SUMMARY OF THE INVENTION

With a piston compressor as mentioned in the introduction, this task is solved in that in the gravity direction the longitudinal bore is open downward and has a ventilation opening upward.

By means of the longitudinal bore being open downward, the lubricant, that is, the oil, which is supplied through the lubricant source, is supplied to the lubrication groove without a gas cushion occurring here, which would hamper the further passage of the lubricant. However, it is not sufficient merely to turn the previously known longitudinal bore, which is open upward, in the piston pin. In this case, a gas bubble will be created inside the piston pin, which may influence the safety for proper lubrication function. When, however, an upward ventilation opening of the longitudinal bore is provided, the longitudinal bore can be filled to a sufficient extent with lubricant, that is, oil. The subsequently supplied oil can then fill the lubrication groove completely. A completely closed lubricant film occurs, which surrounds the piston on its complete circumference. This improves the lubrication between the piston and the cylinder. At the same time, the tightness is improved, so that the efficiency is increased. The improved lubrication conditions increase the life of the compressor.

Preferably, the ventilation opening is arranged at the upper end of the longitudinal bore. Thus, the small amount of gas contained in the longitudinal bore of the piston pin can escape completely. The oil flowing in will always displace the gas upward, due to the substantially lower density of the gas.

Preferably, the longitudinal bore is made as a through-bore. This is a very simple way of ensuring that the longitudinal bore is open downward and has a ventilation opening upward.

Preferably, the ventilation opening is connected with the lubrication groove. Thus, the oil cannot only reach the lubrication groove from the bottom, but also from the top, of the longitudinal bore. Thus, it is possible to supply the lubrication groove from both sides. Particularly when starting the compressor, the desired sealing conditions between piston and cylinder will be reached substantially faster.

Preferably, the ventilation opening of the longitudinal bore is connected with a ventilation path through the piston. Through the ventilation path, gas, which is displaced during the supply of oil, can escape from the piston. Thus, there is no risk of creating a gas cushion, which would influence the lubrication properties. Firstly, the gas would be displaced upward through the ventilation opening and subsequently it would be disposed off through the ventilation path through the piston.

Preferably, the ventilation path has a larger flow resistance for the lubricant than the longitudinal bore and the lubrication groove. When a relatively small ventilation opening is chosen, a certain pressure can build up in the oil system. In a manner of speaking, this will result in a massive or complete oil filling, which can additionally be exposed to a certain pressure and thus cause an improved sealing between the piston and the cylinder. At the same time, the leakage losses of compressed refrigerant gases will be reduced.

Preferably, the ventilation path is formed by at least one recess between piston pin and piston. Through this recess, gas can be displaced. Further, when the gas has been completely displaced, oil can flow in. The manufacturing of such a recess is relatively simple. It makes it possible to start the ventilation path exactly where it is desired, namely at a front side of the piston pin.

Preferably, the piston is hollow and the recess extends from the ventilation opening into the hollow inside of the piston. Thus, the inside of the piston is used as a discharge possibility for the displaced gas and later also for the subsequently supplied oil. Inside the piston, the gas and the oil can have no more damaging effects.

Preferably, the recess is formed by a flattening of the piston pin. This results in a gap-shaped channel between the piston and the piston pin. The axial length of the flattening is chosen so that this gap also extends from the lubrication groove at the outside of the piston into the hollow inside of the piston, that is, the inner chamber limited by the piston housing.

Preferably, the recess is arranged in a plane set up by the lubrication groove. Thus, at both movement and acceleration directions of the piston a certain balance during the outflow of the oil is maintained. If the recess were turned by 90° in relation to the position shown, situations could arise, in which complete oil filling could no longer be maintained. Because of the forces of inertia during acceleration or deceleration of the piston, the amount of oil displaced from the lubrication groove into the recess could, during certain periods of time, be larger than the amount of oil supplied by the lubricant source. Thus, gas could penetrate into the lubrication groove again. When, however, the recess is arranged in the "middle", this situation never occurs. In spite of an alternating acceleration and deceleration of the piston, the displacement conditions are so that the supply of oil substantially balances with the discharge of oil.

Preferably, the recess ends above a bearing surface between piston pin and driving rod. The oil flowing off through the recess can then additionally ensure an improved lubrication of the pin bearing between the piston pin and the driving rod. This again reduces the wear and, due to a smaller friction, improves the efficiency.

Preferably, the piston pin is unrotatably held in the driving rod and rotatably supported in relation to the piston. Until now, the pin in small refrigerant compressors has usually been fixed in the piston by means of a forced fit, that is, held unrotatably, whereas in the connecting rod eye, that is, in the driving rod, the piston pin is rotatably supported. Even when the forced fit is only made on one side of the piston jacket, there is a risk of a slight deformation of the piston, which causes an irregularly shaped gap between the piston and the cylinder. When now the piston pin is held unrotatably in the driving rod, for example, by pressing it into a connecting rod and supporting it rotatably in the piston, the oil supply bore in the driving rod and the corresponding radial bore in the piston pin can be made with a larger diameter. These two bores no longer end in a bearing surface. Accordingly, they no longer influence the creation of a lubricating film. The large bore diameter simplifies the working of the driving rod, as long bores are easier to make with a large diameter than with a small diameter. Finally, the connection between the bore in the connecting rod and the radial bore in the piston pin gets simpler, as there is no relative movement between these two bores. The mentioned way of fixing is particularly suited when using driving rods of light metals or light metal alloys, for example aluminum, which can be used due to the weight saving and a more simple working. However, with this kind of bearing, it is more difficult to ensure a sufficient lubrication of the bearing surfaces between the piston and the piston pin formed in the piston jacket. However, with the embodiment shown, having a through-going longitudinal bore in the piston pin, the lubrication is enabled, as both bearings are supplied regularly with oil under pressure via the through-going axial bore in the pin.

BRIEF DESCRIPTION OF THE DRAWINGS

In the following, the invention is described in detail on the basis of a preferred embodiment in connection with the drawings, showing.

DETAILED DESCRIPTION OF THE PREFERRED EMBODIMENTS

Figure 1:
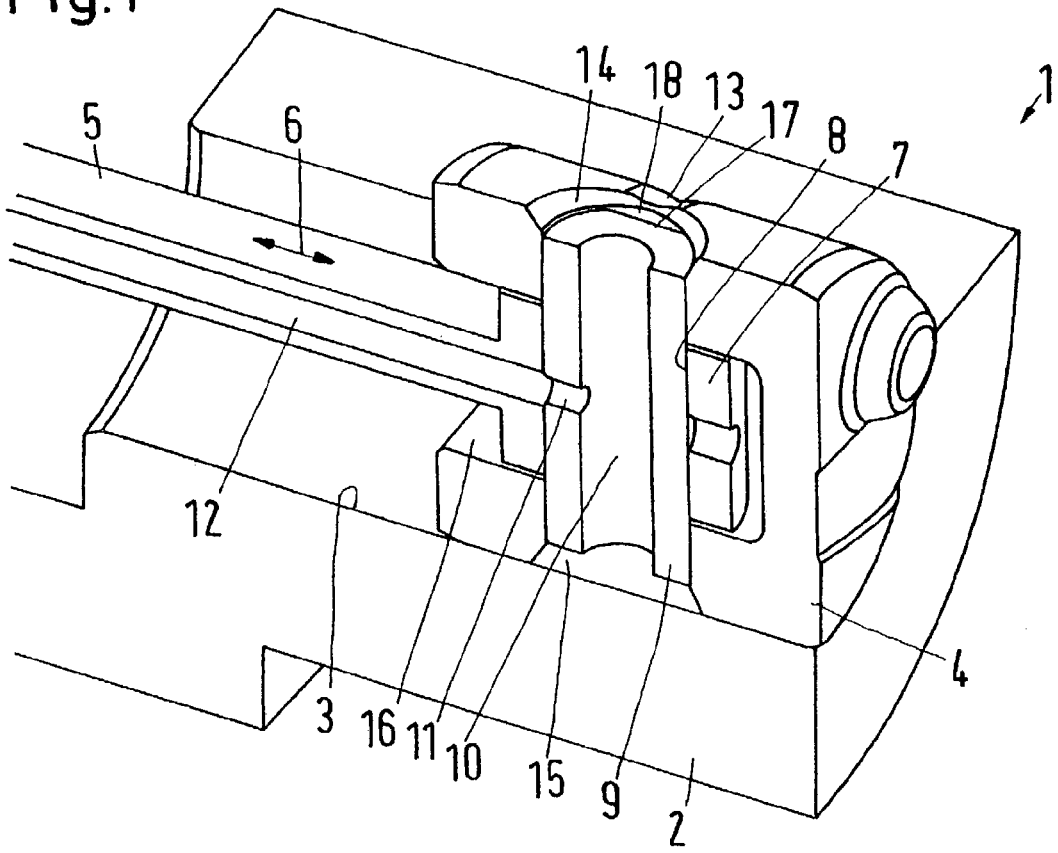
FIG. 1 is a perspective longitudinal view of a component group comprising piston, piston pin and driving rod, in a cylinder
Figure 3:
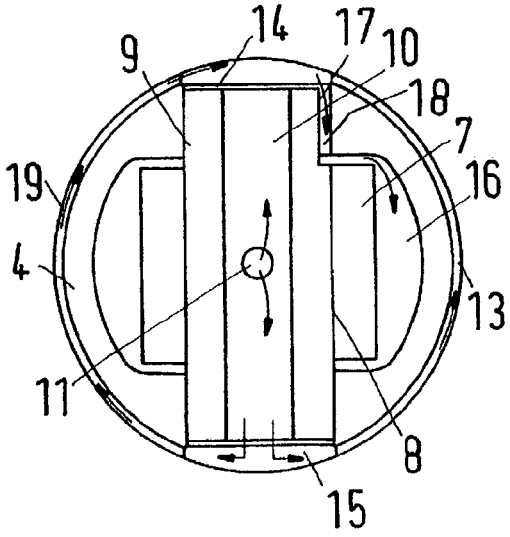
FIG. 3 is a section III-III according to FIG. 2

FIG. 1 shows a section of a reciprocating compressor 1 with a housing 2, in which is arranged a cylinder 3. In the cylinder 3 a piston 4 is arranged to be reciprocating. The driving of the piston appears via a driving rod 5, here in the form of a connecting rod. In a manner known per se and not shown in detail, the other end of the connecting rod is supported on a crankshaft. When the crankshaft rotates, the driving rod 5 reciprocates in the direction of a double arrow 6.

The driving rod 5 is rotatably connected with a piston pin 9 via a connecting rod eye 7, on whose radial inside a pin bearing 8 is formed, that is, the driving rod 5 can rotate in a small angle area in relation to the piston pin 9.

The piston pin 9 has a through-going longitudinal bore 10. In the wall of the piston pin 9 a radial through-bore 11 is provided. This radial bore 11 overlaps the opening of a bore 12 into the driving rod 5. The bore 12 connects the two connecting rod eyes of the driving rod 5 with each other and serves the transport of oil for lubricating the piston 4 and the piston pin 9.

In its circumference, the piston 4 has a lubrication groove 13, which is connected with chambers 14, 15, which are formed on both front sides of the piston pin 9. Further the piston 4 is hollow, that is, it has a hollow inner chamber 16.

On its upper end the piston pin 9 has a flattening 17, which forms a recess 18 between the piston 4 and the piston pin 9. The length of the flattening 17 is chosen so that the recess 18 extends from the chamber 14 at the upper end of the piston pin 9 into the hollow inner chamber 16. Thus, the recess ends above the pin bearing 8.

Arrows 19 show the path of the lubricating oil, which occurs by means of the new design.

Lubricating oil supplied via the longitudinal bore 12 in the driving rod 5 reaches through the radial bore 11 into the longitudinal bore 10 in the piston pin 9. The supply of oil can be intermittent or pulse-like. The oil enters through the radial bore 11 into the longitudinal bore 10 in the piston pin 9 and then initially flows downwards due to gravity and then fills the longitudinal bore 10. Thus, gas that is still contained in the longitudinal bore 10 is displaced upward into the chamber 14. The upper end of the longitudinal bore 10 thus forms a ventilation opening. With increasing oil filling, the gas from the chamber 14 is displaced via the recess 18 into the inner chamber 16 of the piston 4 and can then escape to other areas of the compressor (not shown).

At the same time, the lubrication groove 13 is filled with oil from the lower chamber 15. Gas that still remains in the lubrication groove 13 is displaced upward in the direction of the chamber 14 and can also flow off through the recess 18. After a short while, both the longitudinal bore 10 in the piston pin 9 and the two chambers 14, 15 and the lubrication groove 13 are completely filled with oil. Additionally supplied oil will then flow into the inner chamber 16 of the piston 4 via the recess 18. In this way, oil also gets to the pin bearing 8, which contributes to an improved lubrication effect in the connecting rod eye 7.

The recess 18 meets the oil with a relatively larger flow resistance, so that in the oil system, which is formed by the longitudinal bore 10, the two chambers 14, 15 and the lubrication groove 13, a certain pressure can build up. Primarily the pressure in the lubrication groove 13 ensures that a good lubrication and above all a relatively safe sealing between the piston 4 and the cylinder 3 is provided.

Figure 2:
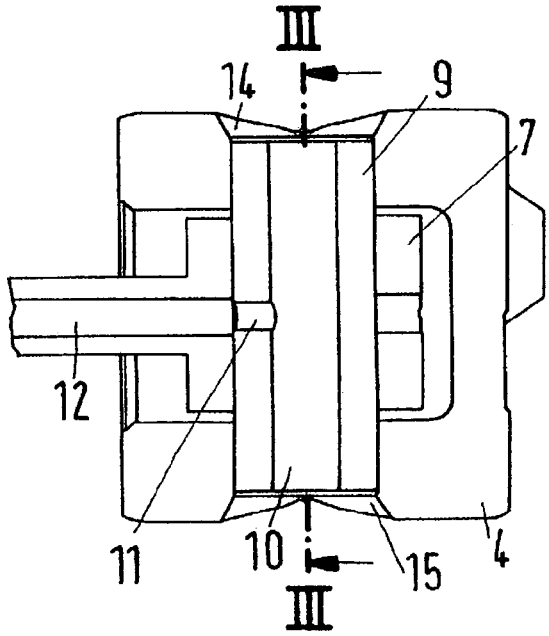
FIG. 2 is a longitudinal section through the piston

As can be seen, particularly from FIG. 2, the piston pin 9 can be extended downward in relation to the known case, as ventilation bores no longer have to be held open in the piston. This improves the mechanical stability. In particular, it is possible to let the piston pin 9 enter the same distance into the jacket of the piston 4 at both ends.

In the axial direction of the piston 4, the recess 18 is arranged in the same position as the lubrication groove 13. In other words, the recess 18 is arranged in a plane, which is set up by the lubrication groove 13. In relation to the movement direction 6 of the piston 4, the recess 18 is arranged approximately in the middle of the chamber 14. Thus, it is in a position, in which a certain minimum amount of oil is always available, both during acceleration and deceleration of the piston 4. Therefore, on the other hand, there is no risk that a too large amount of oil and a resulting too high oil pressure in certain movement phases of the piston 4 will cause the outflow of a too large amount of oil through the recess 18, which can no longer be re-supplied through the longitudinal bore 12 in the driving rod 5.

Of course, the recess 18 can also be made on the opposite side of the piston pin 9, if required also on both sides of the piston pin 9. However, one single flattening 17, which forms a recess 18, will usually be sufficient.

Of course, it is also possible to make the recess 18 in different ways, for example by means of a corresponding working of the piston 4.

The recess 18 practically begins at the highest spot in the upper end area of the lubrication groove 13. Therefore, the complete oil system can be ventilated in a proper and quick manner. Complete oil filling without a mentionable amount of remaining gas is achieved.

When it is ensured that the driving rod 5 is held unrotatably in relation to the piston pin 9 and the piston pin 9 is arranged to be rotatable in the piston, the downward extension of the piston pin 9 can increase the available bearing surface in the lower area, which also has a favourable effect on the life of the reciprocating compressor. In this case, the surface between the piston pin 9 and the piston 4 is also lubricated from the chambers 14, 15, when here the oil is available with a slight overpressure. Otherwise, the oil flow is as described above.

What is claimed is:

1. A piston compressor comprising at least one cylinder and a piston reciprocating in said cylinder, the piston being connected with a driving rod via a piston pin and having in its outer jacket surface a circumferential lubrication groove, the piston pin having a longitudinal bore, which is connected with a lubricant source, and wherein in a gravity direction the longitudinal bore is open downward and has a ventilation opening upward, the ventilation opening of the longitudinal bore is connected with a ventilation path through the piston and, the ventilation path has a larger flow resistance for the lubricant than the longitudinal bore and the lubrication groove.

2. The piston compressor according to claim 1, wherein the ventilation opening is arranged at the upper end of the longitudinal bore.

3. The piston compressor according to claim 1, wherein the longitudinal bore is made as a through-bore.

4. The piston compressor according to claim 1, wherein the ventilation opening is connected with the lubrication groove.

5. The piston compressor according to claim 1, wherein the ventilation path is formed by at least one recess between piston pin and piston.

6. The piston compressor according to claim 5, wherein the piston is hollow and the recess extends from the ventilation opening into the hollow inside of the piston.

7. The piston compressor according to claim 5, wherein the recess is arranged in a plane set up by the lubrication groove.

8. A piston compressor comprising at least one cylinder and a piston reciprocating in said cylinder, the piston being connected with a driving rod via a piston pin and having in its outer jacket surface a circumferential lubrication groove, the piston pin having a longitudinal bore, which is connected with a lubricant source, and wherein in a gravity direction the longitudinal bore is open downward and has a ventilation opening upward, wherein the ventilation opening of the longitudinal bore is connected with a ventilation path through the piston, wherein the ventilation path is formed by at least one recess between piston pin and piston, and wherein the recess is formed by a flattening of the piston pin.

9. A piston compressor comprising at least one cylinder and a piston reciprocating in said cylinder, the piston being connected with a driving rod via a piston pin and having in its outer jacket surface a circumferential lubrication groove, the piston pin having a longitudinal bore, which is connected with a lubricant source, and wherein in a gravity direction the longitudinal bore is open downward and has a ventilation opening upward, wherein the ventilation opening of the longitudinal bore is connected with a ventilation path through the piston, wherein the ventilation path is formed by at least one recess between piston pin and piston, and wherein the recess ends above a bearing surface between piston pin and driving rod.

10. A piston compressor comprising at least one cylinder and a piston reciprocating in said cylinder, the piston being connected with a driving rod via a piston pin and having in its outer jacket surface a circumferential lubrication groove, the piston pin having a longitudinal bore, which is connected with a lubricant source, and wherein in a gravity direction the longitudinal bore is open downward and has a ventilation opening upward, and the piston pin is unrotatably held in the driving rod and rotatably supported in relation to the piston.

* * * * *